US012441525B1

(12) United States Patent
Richard

(10) Patent No.: US 12,441,525 B1
(45) Date of Patent: Oct. 14, 2025

(54) APPARATUS AND METHOD FOR CLOSING A BOTTLE WITH A FLEXIBLE CYLINDER

(71) Applicant: Gary Richard, Danvers, MA (US)

(72) Inventor: Gary Richard, Danvers, MA (US)

( * ) Notice: Subject to any disclaimer, the term of this patent is extended or adjusted under 35 U.S.C. 154(b) by 0 days.

(21) Appl. No.: 18/822,735

(22) Filed: Sep. 3, 2024

(51) Int. Cl.
*B65D 51/00* (2006.01)

(52) U.S. Cl.
CPC ..... *B65D 51/007* (2013.01)

(58) Field of Classification Search
CPC ..... B65D 51/007; B65D 17/4012; B65D 2543/00537; B65D 2517/0041; B65D 55/16; B65D 41/185
See application file for complete search history.

(56) References Cited

U.S. PATENT DOCUMENTS 3,438,529 A * 4/1969 Lohrer ..... B65D 41/485 215/253
4,318,490 A * 3/1982 Schneider ..... B65D 51/00 156/69
5,513,768 A * 5/1996 Smith ..... B65D 41/185 D9/446
5,605,240 A * 2/1997 Guglielmini ..... B65D 51/16 215/256
8,584,695 B2 * 11/2013 Lau ..... F16K 15/202 137/232
9,334,097 B2 * 5/2016 Skillin ..... B65D 75/5883
2011/0049172 A1 * 3/2011 Shemesh ..... B65D 51/007 220/729

* cited by examiner

*Primary Examiner* — Shawn M Braden
(74) *Attorney, Agent, or Firm* — Richard A. Baker, Jr.

(57) ABSTRACT

An apparatus comprising a cylinder of flexible material, where the diameter of the cylinder matches the outside diameter of a bottle neck. The apparatus includes a solid top surface with a top ring of flexible material extending around the circumference, and an underside containing a centered raised circle matching the inside diameter of the bottle neck. The solid top surface is designed to cover the top opening of the bottle neck. The cylinder has an open bottom end with a bottom ring of flexible material extending around the circumference, configured to slide over the bottle neck. Inside the cylinder, a void extends from below the solid top surface through the open bottom end. A first elliptical opening in the cylinder wall extends around at least 50% of the circumference, allowing the solid top surface to be removed from the bottle neck by stretching the flexible material so that the top opening of the bottle neck extends through the elliptical opening.

20 Claims, 6 Drawing Sheets

APPARATUS AND METHOD FOR CLOSING A BOTTLE WITH A FLEXIBLE CYLINDER

CROSS-REFERENCE TO RELATED APPLICATIONS

This is a priority patent application. It is related to a design patent application, "Bottle Closer", simultaneously filed by Gery Richard, said design patent application incorporated herein by reference in its entirety.

FIELD OF THE INVENTIONS

The present invention generally relates to bottle closure devices, and more particularly relates to flexible, stretchable apparatuses designed to securely cover and seal the neck of a bottle while allowing easy bottle access.

BACKGROUND

Beverage bottles have been used for many centuries, to hold liquids for consumption. There has always been a need to securely close the bottle to protect the contents of the bottle, and to extend the freshness life, as long as possible, and to keep bugs and debris out. Corks have been used for many years, and are still used to this day, especially in wine bottles. Metal caps, usually with a softer lining material have been a popular method for sealing, though they generally are a single-use device, as they are damaged when removed.

Once a seal has been removed, the need to reseal the bottle becomes a challenge. Corks, which have been press-fit into the bottle neck, often expand, making them difficult to re-install. Corks are also porous, allowing air to often migrate into the bottle and spoiling the integrity of the contents. Corks can also break up, putting unwanted particulate into the beverage. Metal caps which have been press-fit onto the bottle, are generally bent, making it virtually impossible to re-install.

In more modern times, twist-off caps have become a more practical method for sealing and re-sealing the contents, though it becomes tedious to do so repeatedly. Therefore, there is a need for a practical device, which can be conveniently installed to protect the integrity of the contents. The device must also be designed for easy cleaning and repeated usage, and of a material which is safe for the contents, and safe for contact with the consumer.

SUMMARY

In some aspects, the techniques described herein relate to an apparatus including: a cylinder of flexible material, where a diameter of the cylinder is an outside diameter of a neck of a bottle; a solid top surface of the cylinder with a top ring of the flexible material extending around a circumference of the cylinder along a cylinder wall, an underside of the solid top surface containing a centered raised circle an inside diameter of the neck of the bottle, the solid top surface configured to cover a top opening of the neck of the bottle; an open bottom end of the cylinder with a bottom ring of the flexible material extending around the circumference of the cylinder along the cylinder wall, the bottom ring configured to slide over the neck of the bottle; a void inside of the cylinder, extending from below the solid top surface through the open bottom end; and a first elliptical opening in the cylinder wall, the first elliptical opening extending around at least 50% of the circumference of the cylinder, the first elliptical opening configured to allow the solid top surface to be removed from the top opening of the neck of the bottle by stretching the flexible material such that the top opening of the neck of the bottle extends through the first elliptical opening.

In some aspects, the techniques described herein relate to an apparatus further including a second, smaller elliptical opening opposite the first elliptical opening on the cylinder wall.

In some aspects, the techniques described herein relate to an apparatus where the first elliptical opening and the second, smaller elliptical opening are configured to accept a can cap covering.

In some aspects, the techniques described herein relate to an apparatus further configured to attach the apparatus and the can cap covering to a keychain.

In some aspects, the techniques described herein relate to an apparatus where the flexible material includes a Thermoplastic elastomer.

In some aspects, the techniques described herein relate to an apparatus where the flexible material includes silicone.

In some aspects, the techniques described herein relate to an apparatus where the bottle is a beer bottle.

In some aspects, the techniques described herein relate to an apparatus where the bottle is a wine bottle.

In some aspects, the techniques described herein relate to an apparatus where the bottle is a soda bottle.

In some aspects, the techniques described herein relate to an apparatus further including circumferential frontal ribs around at least a portion of the top ring.

In some aspects, the techniques described herein relate to an apparatus further including a radiused indent in the solid top surface.

In some aspects, the techniques described herein relate to a method including: stretching a bottom ring of a bottle closer apparatus over a neck of a bottle, where the bottle closer apparatus includes: a cylinder of flexible material, where a diameter of the cylinder is an outside diameter of the neck of the bottle; a solid top surface of the cylinder with a top ring of the flexible material extending around a circumference of the cylinder along a cylinder wall, an underside of the solid top surface containing a centered raised circle an inside diameter of the neck of the bottle; an open bottom end of the cylinder with a bottom ring of the flexible material extending around the circumference of the cylinder along the cylinder wall; a void inside of the cylinder, extending from below the solid top surface through the open bottom end; and a first elliptical opening in the cylinder wall, the first elliptical opening extending around at least 50% of the circumference of the cylinder; pulling the bottom ring down the neck of the bottle until the solid top surface is snug on a top opening of the neck of the bottle; and lifting the solid top surface by stretching the first elliptical opening and pushing the top opening in the neck such that the top opening of the bottle extends through the first elliptical opening.

In some aspects, the techniques described herein relate to a method further including a second, smaller elliptical opening opposite the first elliptical opening on the cylinder wall.

In some aspects, the techniques described herein relate to a method where the flexible material includes a Thermoplastic elastomer.

In some aspects, the techniques described herein relate to a method where the flexible material includes silicone.

In some aspects, the techniques described herein relate to a method where the bottle is a beer bottle.

In some aspects, the techniques described herein relate to a method where the bottle is a wine bottle.

In some aspects, the techniques described herein relate to a method where the bottle is a soda bottle.

In some aspects, the techniques described herein relate to a method where the top ring further includes circumferential frontal ribs.

In some aspects, the techniques described herein relate to a method further including folding the solid top surface into the neck of the bottle such that the solid top surface remains away from the top opening in the neck of the bottle.

BRIEF DESCRIPTION OF THE DRAWINGS

The foregoing summary, as well as the following detailed description of preferred variations of the invention, will be better understood when read in conjunction with the appended drawings. For the purpose of illustrating the invention, there are shown in the drawings variations that are presently preferred. It should be understood, however, that the invention is not limited to the precise arrangements shown. In the drawings, where.

DETAILED DESCRIPTION

Figure 1:
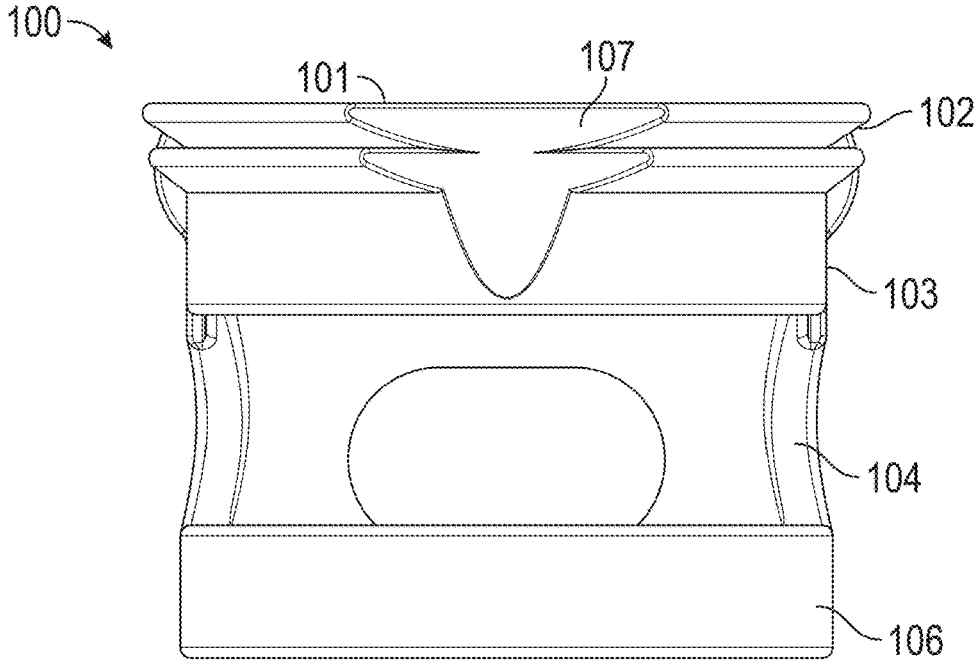
FIG. 1 shows a front view of the inclusive bottle closer.

All illustrations of the drawings are for the purpose of describing selected versions of the present invention and are not intended to limit the scope of the present invention.

The description herein describes an inclusive bottle closer that securely and conveniently reseals a bottle. If the problem of securely and conveniently resealing bottles were solved, several benefits could be realized. An effective bottle closer would prevent bugs, dirt, and other materials from entering the bottle, thereby maintaining the cleanliness and safety of the contents while a user is enjoying his drink. It would also be useful in preventing the unknowing introduction of drugs such as GBH, Rohypnol, Benzodiazepines, ketamine, or similar substances in social drinking situations. Additionally, a set of bottle closers in different colors would allow users to easily identify their personal bottles, reducing the risk of accidental mix-ups. Furthermore, an effective bottle closer would minimize spillage and slow the rate at which a drink becomes flat, thereby enhancing the overall drinking experience.

The inclusive bottle closer 100 device is described herein addresses these issues. The device may be flexible and stretch over most of these variations, and the device's integral bottom ring 106 positions under the bottle's rounded ring area gripping it in place, so that the top closing portion of the device may be securely pulled back for access to the beverage. The device may be designed for easy cleaning and repeated usage, and of a material that is safe for the contents, and safe for contact with the consumer. The top 101, when closed over the bottle top 901, could also be used as a bottle opener, providing a gripping surface to twist a bottle cap off of the bottle 801.

Bottle neck 802 can vary in shape and size and may be threaded for twist-off caps. Traditional wine bottles 801 tops are different than beer and other beverage tops, though most bottles generally have a rounded ring area, which helps in packaging and handling. The device is flexible and stretches over most of these variations, and the inclusive bottle closer 100 device's integral bottom ring positions under the bottle's rounded ring area gripping it in place, so that the top closing portion of the inclusive bottle closer 100 device may be securely pulled back for access to the beverage.

The inclusive bottle closer 100 device's top 101 closing section is connected to the bottom gripping ring 106 by rounded support sections 201. The rounded support sections 201 create a strong, multi-use virtual hinge, allowing the top 101 to flex backward repeatedly, for beverage consumption. The designed strength of the virtual hinge area creates a spring action when the top 101 is released. The top 101 section quickly snaps forward over the bottle opening 901, closing the top of the bottle 801, and preserving and protecting the contents of the bottle.

Products are more likely to be used when they are made to be convenient. The inclusive bottle closer 100 may be designed to hold a can cap covering 1001. The can cap covering 1001 may be the commercial product The Cappy, described in U.S. Pat. No. 8,025,170, said patent incorporated herein by reference. Being able to host and transport a can cap covering 1001 beverage closing device, in the open and unused space of this inclusive bottle closer 100 device may be a very useful and convenient feature.

The device can host the can cap covering 1001 by installing it into the open inclusive bottle closer 100 device cavity and extending the can cap covering's 1001 keychain hole 1002 through the open accommodation (the smaller elliptical opening 105) in the back support sections of the inclusive bottle closer 100 device. The tandem beverage closing devices are then easily transported on a keychain 1101.

To further minimize the tandem sizing, the bottom ring 106 of the device may be stretched over the top 101 of the device and positioned into the side locking channels 301,401 securely encapsulating the can cap covering 1001 into place for even easier transport.

The top 101 closing lid has circumferential frontal ribs 102, for gripping ease when lifting and pushing it backward out of the way for the consumer to access the contents, plus a larger circumferential grip 202 on the back of the device for finger stability when utilizing the device.

The intent of the device is to protect and extend the integrity of the bottle contents, the consumer may not always want to have it close after every consumption, so the device must be able to conveniently park the top 101 closing lid to the side. The device has a radiused indent 107 in the frontal gripping ribs 102, which conforms to the outer shape of the bottle 801, plus a firm edge that locks the device under the bottle's rounded ring. This locking action may then be disengaged, allowing the device to once again close the bottle 801.

To form a secure seal, the top 101 closing lid has a raised integral circumferential protrusion, which faces downward to enter the bottle opening, to effect a seal, protecting and extending the integrity of the bottle contents.

Specifically looking to FIG. 1, the inclusive bottle closer 100 is shown from a front view. The inclusive bottle closer 100 may be a cylinder of flexible material, about 30 mm wide (outside diameter), 26 mm tall, and 2 mm thick.

The inclusive bottle closer 100 may include a top 101 with circumferential frontal ribs 102 extending about 180 degrees around the front of the inclusive bottle closer 100. The circumferential frontal ribs 102 may start at the top 101 and end 5.4 mm below the top 101. In that space, there may be two 2.7 mm circumferential frontal ribs 102. The rear 180 degrees of the top 101 has a single rounded support section 201, 6.5 mm high, and 6.5 mm wide on the top of the side wall 201. The top 101 surface is of solid, flexible material, and approximately flat across the top. Below the circumferential frontal ribs 102 on the front and the larger circumferential grip 202 on the back is the top ring 103. The top ring 103 is approximately 5.6 mm wide in the front (6.4 mm in the back) and extends around the circumference of the inclusive bottle closer 100.

In some embodiments, the top 101 may have a flap on the surface, partially connected to the top 101, perhaps 8 mm in diameter, and the same thickness and material as the top 101. This flexible flap is normally closed but is configured to accept a straw, with the flap moving inwards when a straw is inserted. When the straw is removed, the flap returns to the closed position. The flap may be placed in any location on the top 101 of the inclusive bottle closer 100.

There may be two elliptical holes in the rounded support sections 201, the walls of the inclusive bottle closer 100. The larger elliptical hole 104 is on the front of the inclusive bottle closer 100 below the top ring 103, about 5.6 mm below the circumferential frontal ribs 102. The larger elliptical hole 104 may be 10 mm tall and 57 mm wide, located about 6 mm from the bottom of the inclusive bottle closer 100. The smaller elliptical opening 105 may be 15 mm wide and 9 mm tall. It is located 6 mm below the larger circumferential grip 202 and 5 mm from the bottom of the inclusive bottle closer 100. It is equidistant around the circumference from the larger elliptical hole 104 at about 11 mm on each side. In some embodiments, the smaller elliptical opening 105 may be the same height as the larger elliptical hole 104.

The side of the inclusive bottle closer 100 has an integral bottom ring 106, at about 11 mm from the bottom, about 6 mm wide (5 mm in the back) that extends around the rear of the inclusive bottle closer 100.

Figure 2:
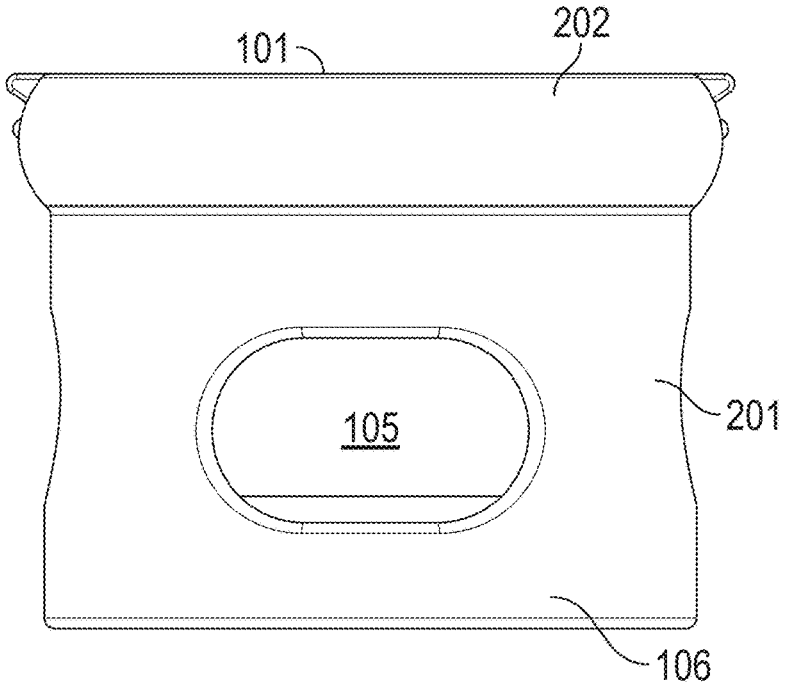
FIG. 2 shows a back view of the inclusive bottle closer.

FIG. 2 shows the rear view of the inclusive bottle closer 100. The larger circumferential grip 202 can be seen at the top, and the rounded support sections 201 are seen on the sides of the smaller elliptical opening 105, which resides above the integral bottom ring 106.

Figure 3:
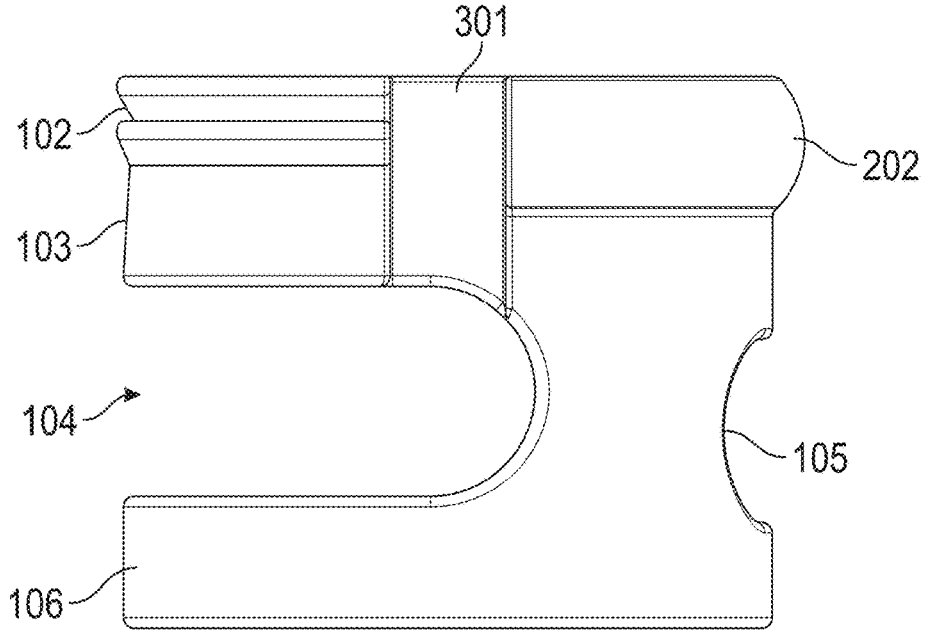
FIG. 3 shows a left view of the inclusive bottle closer.
Figure 4:
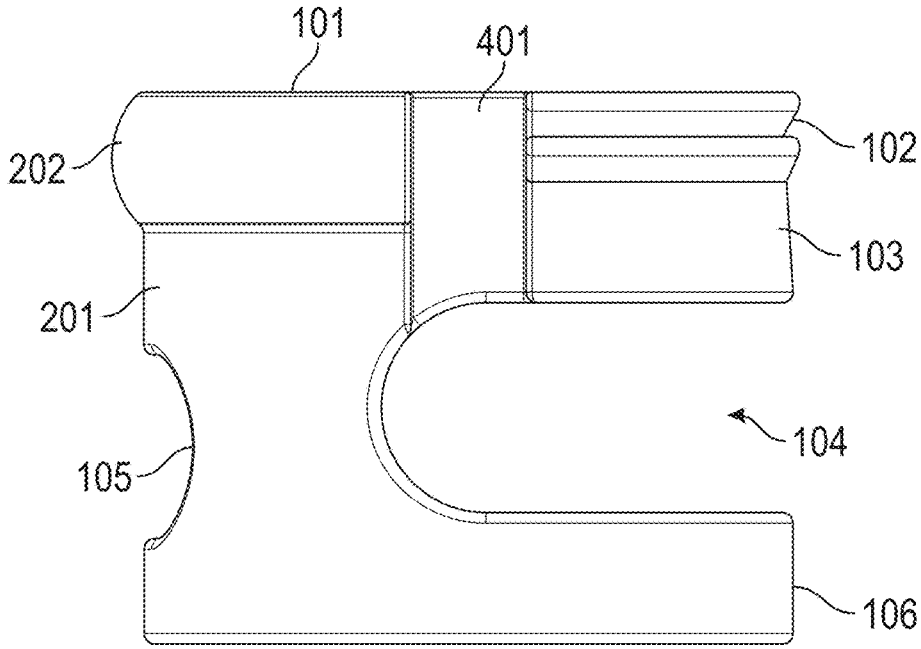
FIG. 4 shows a right view of the inclusive bottle closer.

FIG. 3 shows the right side and FIG. 4 shows the left side of the inclusive bottle closer 100. Each side has a right slot 301 or left slot 401, 10 mm long, 5.5 mm wide, and 3 mm deep. The right slot 301 and left slot 401 extend from the top 101 to the larger elliptical hole 104. The right slot 301 and left slot 401 could be opposite each other on opposite sides of the inclusive bottle closer 100.

Figure 5:
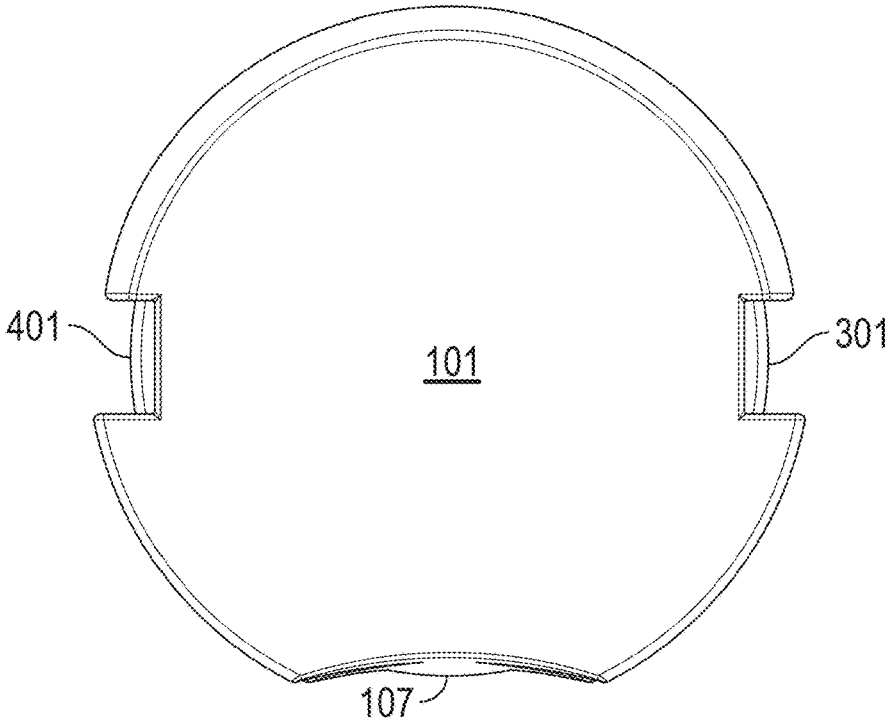
FIG. 5 shows a top view of the inclusive bottle closer.

The top 101 can be seen in FIG. 5. The positions right slot 301 and left slot 401 are visible, as is the radiused indent 107. The radiused indent 107 may be about 15 mm around the circumference of the top 101, and has a radiused indent of about 1.2 mm deep. This radiused indent 107 extends downwards to the larger elliptical hole 104.

Figure 6:
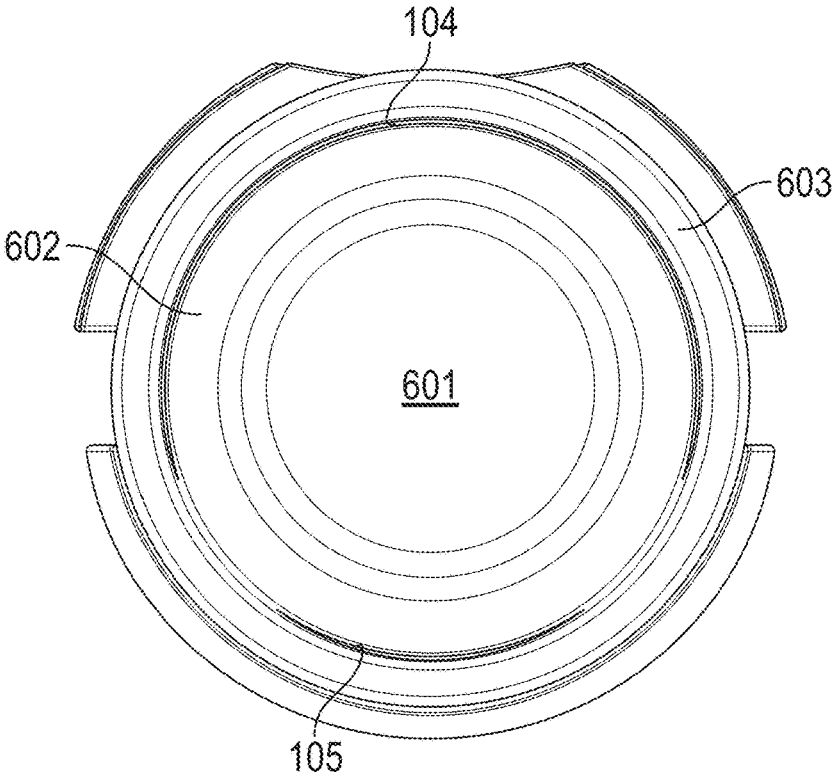
FIG. 6 shows a bottom view of the inclusive bottle closer.

FIG. 6 shows a view of the bottom 603 of the inclusive bottle closer 100. The bottom 603 may be 2-3 mm in thickness, and forms a circle at the bottom of the inclusive bottle closer 100 cylinder, creating a void inside of the rounded support sections 201 and beneath the top 101. Underneath the top 101 (the underside of the top 101) is a raised circle 601 of approximately the inner diameter of the opening in the bottle 801. Recessed inside the raised circle 601 is a recessed circle 602. The top opening in the bottle 801 mates with the recessed circle 602, and may form a liquid-tight seal over the top of the bottle 801.

Figure 7:
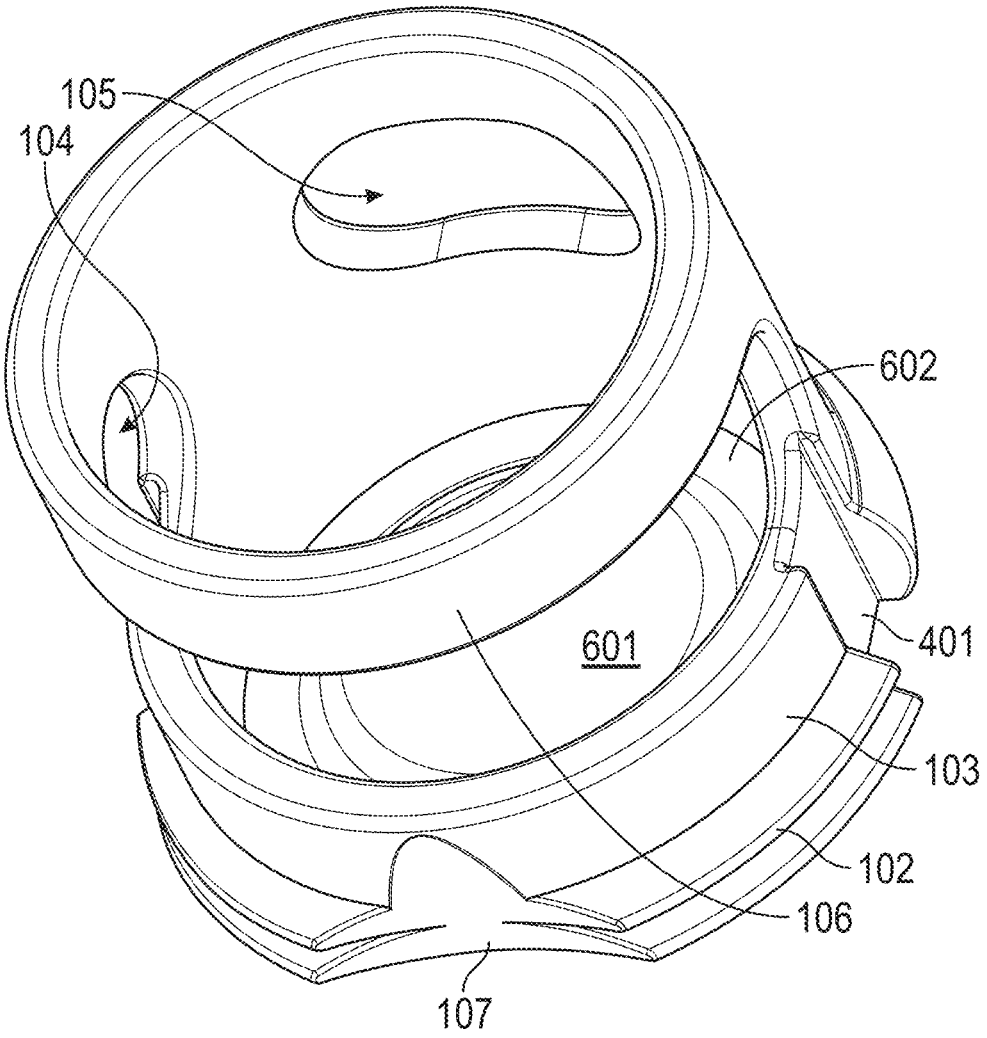
FIG. 7 shows a perspective view of the inclusive bottle closer.

FIG. 7 shows a perspective view of the inclusive bottle closer 100 from the bottom center left. The larger elliptical hole 104 and the smaller elliptical opening 105 are visible, as is the bottom of the top 101, with the raised circle 601 and the recessed circle 602. The circumferential frontal ribs 102 and raised indent 107 features of the top are apparent in this view, as are the top ring 103 and larger elliptical hole 104.

Figure 8:
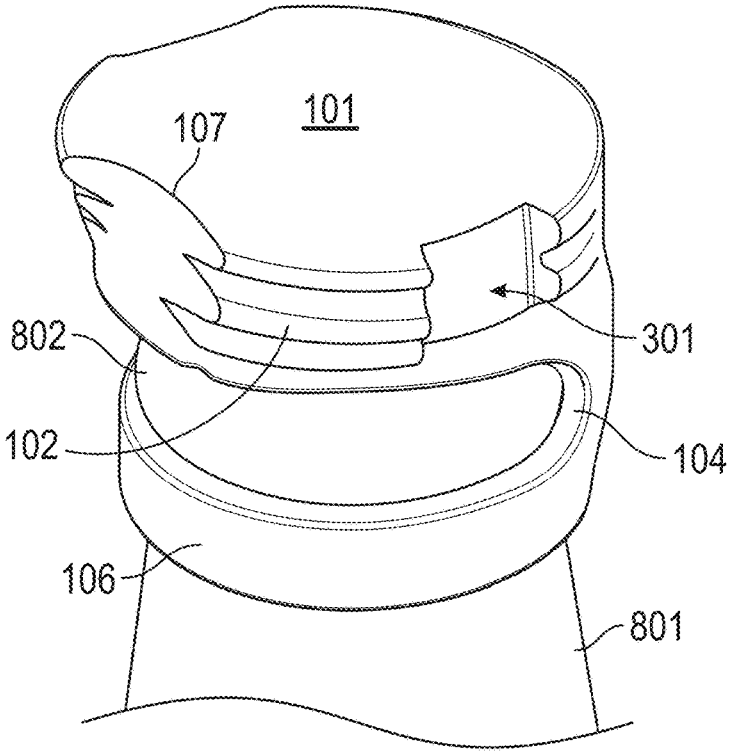
FIG. 8 shows a perspective view of the inclusive bottle closer on a bottle.

FIG. 8 shows the inclusive bottle closer 100 installed on the top of a bottle 801. The bottle neck 802 is visible through the larger elliptical hole 104. The integral bottom ring 106 attaches around the bottle neck 802. The top 101 secures the bottle 801 opening closed.

The bottle 801 could be any bottle, such as a beer bottle, an ale bottle, a mead bottle, a cider bottle, a wine bottle, a champagne bottle, a soda (soft drink) bottle, a water bottle, a milk bottle, a juice bottle, a hard liquor (vodka, gin, whiskey, scotch, tequila, rum, etc) bottle, a baby bottle, a vinegar bottle, an olive (or other cooking oil) bottle, a condiment bottle, a medicine bottle, or similar.

The method to use the inclusive bottle closer 100 apparatus, the integral bottom ring 106 is slipped over the bottle opening 901 and pulled down the bottle neck 802 until the integral bottom ring 106 is snug on the bottle neck 802. The top 101 is then fit over the bottle opening 901, restricting flow of fluid from the bottle 801 if the bottle 801 is tipped over. When the user desires to drink from the bottle 801, the top 101 is flipped off of the bottle opening 901 using the circumferential frontal ribs 102 grip on the top 101. The user can either take a drink or the user can fold the top 101 down against the bottle neck 802. To fold the top 101 down on the bottle neck 802, the top 101 is pushed back from the bottle opening 901, and the radiused indent 107 is placed against the bottle neck 802, thus allowing the top 101 to remain away from the bottle opening 901.

Figure 9:
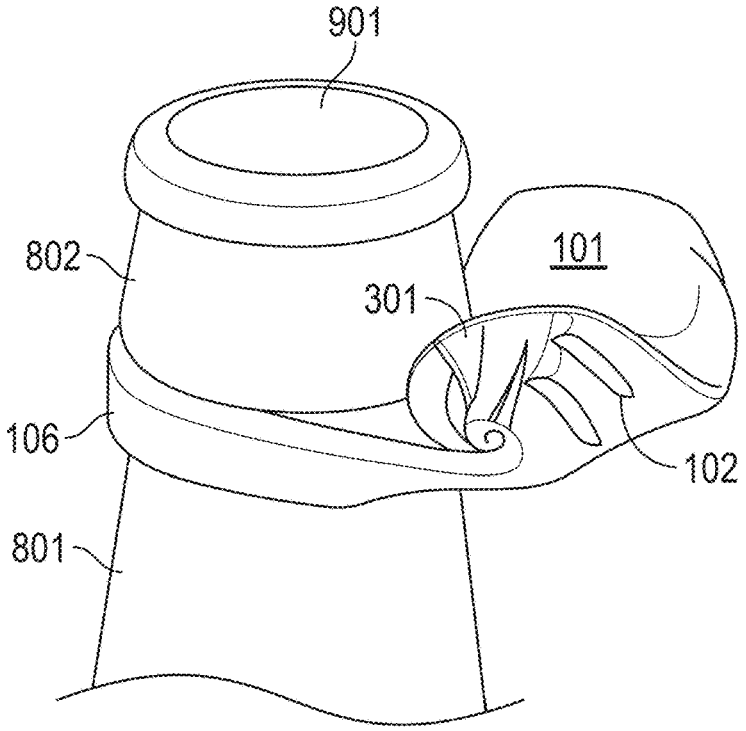
FIG. 9 shows a perspective view of the inclusive bottle closer in an open position on a bottle.

FIG. 9 shows the inclusive bottle closer 100 installed on a bottle 801 with the inclusive bottle closer 100 folded into a stored position for drinking the contents of the bottle 801. The integral bottom ring 106 is around the bottle neck 802. The bottle opening 901 is visible, and the top 101 of the inclusive bottle closer 100 is folded in with the radiused indent 107 pressed against the bottle neck 802, holding the inclusive bottle closer 100 in the open position. This allows the user to drink without interference from the inclusive bottle closer 100.

Figure 10:
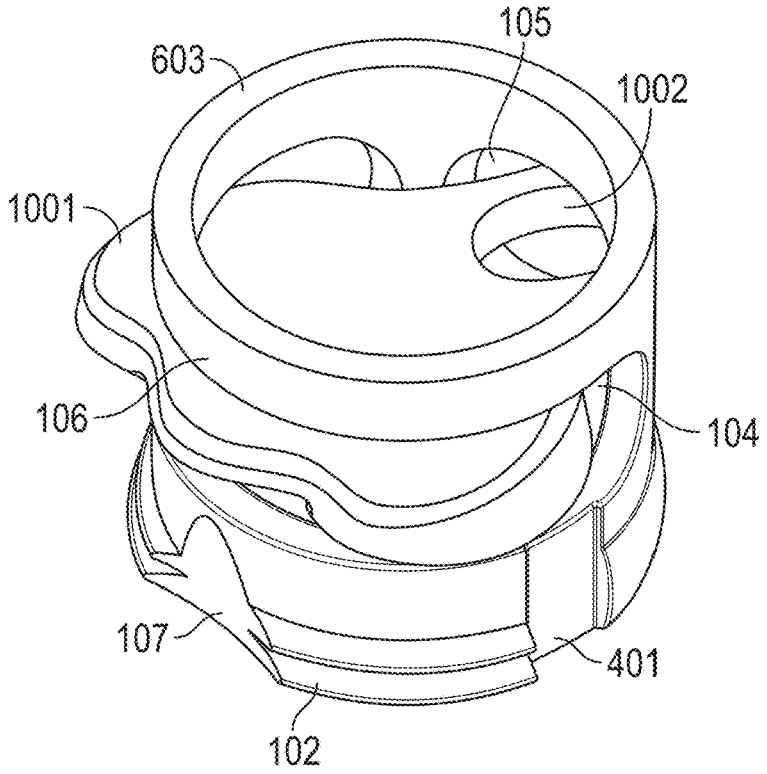
FIG. 10 shows the inclusive bottle closer with a can closing device inserted in the inclusive bottle closer.

FIG. 10 demonstrates a can cap covering 1001 inserted in the inclusive bottle closer 100 for easy storage. The can cap covering 1001 has a keychain hole 1002 that may be inserted through the larger elliptical hole 104 and into the smaller elliptical opening 105.

Figure 11:
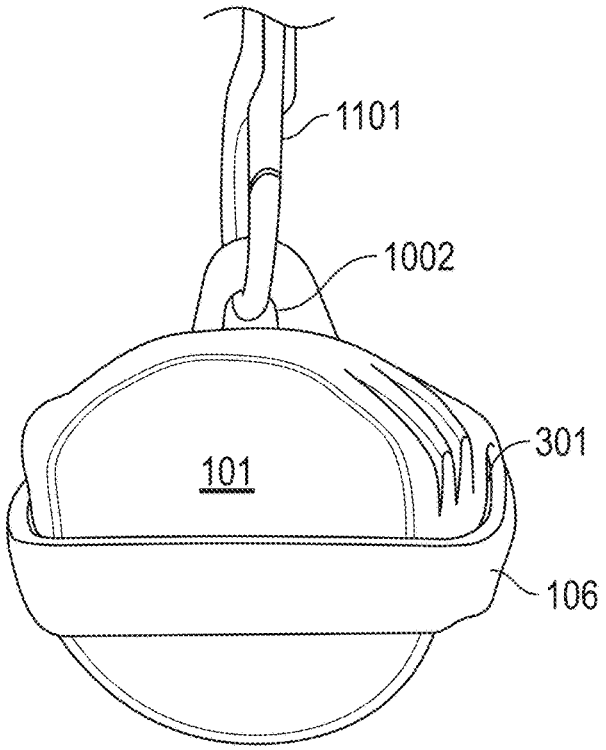
FIG. 11 shows the inclusive bottle closer with a can closing device secured inside of the inclusive bottle closer.

In FIG. 11, the integral bottom ring 106 is stretched around the top 101 and the can cap covering 1001 to hold the can cap covering 1001 tightly within the inclusive bottle closer 100. The integral bottom ring 106 fits in the right slot 301 and left slot 401, holding the assembly together. A keychain 1101 can then be attached to the keychain hole 1002 for easy carrying. This allows the user to easily carry both the inclusive bottle closer 100 and the can cap covering 1001 to a social event, and when there decide whether to drink from a bottle or can.

The inclusive bottle closer 100 may be made from flexible materials such as elastomeric materials, which are made for indirect food contact surfaces and may be compliant with the regulations of the United States Food and Drug Administration. Elastomeric materials may include Thermoplastic elastomers (TPE), sometimes referred to as thermoplastic rubbers (TPR), which are a class of copolymers or a physical mix of polymers (usually a plastic and a rubber) that consist of materials with both thermoplastic and elastomeric properties. While most elastomers are thermosets, thermoplastics may be used in an injection molding process. Thermoplastic elastomers show advantages typical of both rubbery materials and plastic materials. The benefit of using thermoplastic elastomers is the ability to stretch to moderate elongations and return to its near original shape creating a longer life and better physical range than other materials. In other embodiments, silicone, liquid silicone rubber (LSR), thermoplastic polyurethane (TPU), rubber, polyamide elastomer, polyester elastomer, thermoplastic vulcanizate, styrene-ethylene butadiene-styrene, olefin block copolymer, thermoplastic polyolefin, styrene-butadiene-styrene, polyolefin elastomer, ethylene vinyl acetate, flexible polyvinyl chloride, polyisoprene, nitrile, neoprene, or similar materials could be used The inclusive bottle closer 100 could be manufactured with injection molding. In other embodiments, the inclusive bottle closer could be manufactured with 3-D printing, over-molding processes, compression molding, blow manufacturing, melt calendaring, thermoforming, extrusion, heat welding, or similar processes.

The present invention has been described in terms of specific embodiments incorporating details to facilitate the understanding of the principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims. All dimensions are given as examples, and may be changed without detracting from the inventions herein.

The foregoing devices and operations, including their implementation, will be familiar to, and understood by, those having ordinary skill in the art.

The above description of the embodiments, alternative embodiments, and specific examples, are given by way of illustration and should not be viewed as limiting. Further, many changes and modifications within the scope of the present embodiments may be made without departing from the spirit thereof, and the present invention includes such changes and modifications.

I claim:

1. An apparatus comprising:

a cylinder of flexible material, where a diameter of the cylinder is an outside diameter of a neck of a bottle;

a solid top surface of the cylinder with a top ring of the flexible material extending around a circumference of the cylinder along a cylinder wall, an underside of the solid top surface containing a centered raised circle an inside diameter of the neck of the bottle, the solid top surface configured to cover a top opening of the neck of the bottle;

an open bottom end of the cylinder with a bottom ring of the flexible material extending around the circumference of the cylinder along the cylinder wall, the bottom ring configured to slide over the neck of the bottle;

a void inside of the cylinder, extending from below the solid top surface through the open bottom end; and a first elliptical opening in the cylinder wall, the first elliptical opening extending around at least 50% of the circumference of the cylinder, the first elliptical opening configured to allow the solid top surface to be removed from the top opening of the neck of the bottle by stretching the flexible material such that the top opening of the neck of the bottle extends through the first elliptical opening.

2. The apparatus of claim 1 further comprising a second, smaller elliptical opening opposite the first elliptical opening on the cylinder wall.

3. The apparatus of claim 2 where the first elliptical opening and the second, smaller elliptical opening are configured to accept a can cap covering.

4. The apparatus of claim 3 further configured to attach the apparatus and the can cap covering to a keychain.

5. The apparatus of claim 1 where the flexible material comprises a Thermoplastic elastomer.

6. The apparatus of claim 1 where the flexible material comprises silicone.

7. The apparatus of claim 1 where the bottle is a beer bottle.

8. The apparatus of claim 1 where the bottle is a wine bottle.

9. The apparatus of claim 1 where the bottle is a soda bottle.

10. The apparatus of claim 1 further comprising circumferential frontal ribs around at least a portion of the top ring.

11. The apparatus of claim 1 further comprising a radiused indent in the solid top surface.

12. A method comprising:

stretching a bottom ring of a bottle closer apparatus over a neck of a bottle, where the bottle closer apparatus includes:

a cylinder of flexible material, where a diameter of the cylinder is an outside diameter of the neck of the bottle;

a solid top surface of the cylinder with a top ring of the flexible material extending around a circumference of the cylinder along a cylinder wall, an underside of the solid top surface containing a centered raised circle an inside diameter of the neck of the bottle;

an open bottom end of the cylinder with a bottom ring of the flexible material extending around the circumference of the cylinder along the cylinder wall;

a void inside of the cylinder, extending from below the solid top surface through the open bottom end; and a first elliptical opening in the cylinder wall, the first elliptical opening extending around at least 50% of the circumference of the cylinder;

pulling the bottom ring down the neck of the bottle until the solid top surface is snug on a top opening of the neck of the bottle; and lifting the solid top surface by stretching the first elliptical opening and pushing the top opening in the neck such that the top opening of the bottle extends through the first elliptical opening.

13. The method of claim 12 further comprising a second, smaller elliptical opening opposite the first elliptical opening on the cylinder wall.

14. The method of claim 12 where the flexible material comprises a Thermoplastic elastomer.

15. The method of claim 12 where the flexible material comprises silicone.

16. The method of claim 12 where the bottle is a beer bottle.

17. The method of claim 12 where the bottle is a wine bottle.

18. The method of claim 12 where the bottle is a soda bottle.

19. The method of claim 12 where the top ring further includes circumferential frontal ribs.

20. The method of claim 12 further comprising folding the solid top surface into the neck of the bottle such that the solid top surface remains away from the top opening in the neck of the bottle.

* * * * *